US005970655A

United States Patent [19]

Freeman

[11] Patent Number: 5,970,655

[45] Date of Patent: Oct. 26, 1999

[54] CHRISTMAS TREE SUPPORT APPARATUS AND METHOD

[76] Inventor: Jerry K. M. Freeman, 2689 Dark Star Ave., Henderson, Nev. 89014

[21] Appl. No.: 08/888,086

[22] Filed: Jul. 3, 1997

[51] Int. Cl.[6] ..... A01G 27/06

[52] U.S. Cl. ..... 47/43; 47/40.5

[58] Field of Search ..... 47/40.5, 42, 43

[56] References Cited

U.S. PATENT DOCUMENTS

| | | | |
|---|---|---|---|
| 2,531,690 | 11/1950 | Kennel | 47/40.5 |
| 2,875,968 | 3/1959 | Ekola | 47/40.5 |
| 3,851,629 | 12/1974 | Merrill | 47/40.5 |
| 5,188,330 | 2/1993 | Curtis, Jr. | 47/40.5 X |
| 5,465,529 | 11/1995 | Park | 47/40.5 |
| 5,551,659 | 9/1996 | Sofy | 47/40.5 X |

*Primary Examiner*—Robert P. Swiatek
*Assistant Examiner*—Elizabeth Shaw
*Attorney, Agent, or Firm*—Harry M. Weiss; Jeffrey D. Moy; Harry M. Weiss & Associates, P.C.

[57] ABSTRACT

A Christmas tree support apparatus and method is disclosed wherein a collar member is provided around a base portion of a Christmas tree. A radial extension member is removably connected to the collar and to a rod at one end thereof which connection between the radial extension member and the rod can be adjusted. The other end of the rod is connected to the Christmas tree above the center of gravity point thereof.

14 Claims, 4 Drawing Sheets

CHRISTMAS TREE SUPPORT APPARATUS AND METHOD

BACKGROUND OF THE INVENTION

1. Field of the Invention

This invention generally relates to apparatus and methods for supporting vertical objects and, more particularly, relates to an apparatus and method for supporting cut Christmas trees that are used in the home and office and that require additional support to stabilize the Christmas tree. This invention specifically relates to an apparatus and method for supporting cut Christmas trees that are placed in a Christmas tree support holder stand.

2. Description of the Prior Art

The majority of Christmas tree support holder stands that are presently used are deficient in reliably supporting and displaying Christmas trees because the Christmas trees are very unstable when mounted in a vertical position.

Many of the Christmas tree support holder stands that were manufactured are attached to the bottom portion of the Christmas tree trunk usually several inches below the lowest limbs of the Christmas tree which is often inadequate to effectively stabilize the Christmas tree in a vertical position; especially if the Christmas tree is tall or broad.

More recently, Christmas tree stands were developed to stabilize the Christmas tree in such a way that a base support member and angular tree support members were attached relatively high on the Christmas tree trunk which required the removal of lower tree branches. Upon removal of the lower tree branches for this attachment, the remaining branches were higher off the floor than anticipated causing a less than desirable appearance provided by the Christmas tree.

Initially, the use of Christmas tree support stands with cross members nailed to the bottom of the Christmas tree would provide some support for the Christmas tree without the need for removing the lower branches thereof. However, this type of stand did not have a pan to store water to keep the Christmas tree fresh in appearance. Christmas tree stands that are presently available are usually constructed to store water in a bottom pan to keep the Christmas tree fresh in appearance, but lack an effective means to firmly secure the tree trunk to the tree holder stand several inches above the base of the tree trunk.

Although the presence of branches on the Christmas tree may be such as to provide a symmetric and desirable shape and appearance the tree trunk may be angular, curved or otherwise irregular that may result in an unbalanced weight distribution of the Christmas tree when attached in such a manner as to make the Christmas tree appear straight. This uneven weight distribution resulted in an unstable arrangement whereby the Christmas tree can be toppled easily from this upright position.

Several types of Christmas tree stands have been proposed for example in U.S. Pat. No. 2,455,404 to Brown et al. (1948), U.S. Pat. No. 2,502,040 to Franklin (1950) and U.S. Pat. No. 2,617,617 to Krastel et al (1952) wherein the tree trunk was engaged close to the butt of the tree substantially below the height of the center of mass of the tree. The base support area on which the Christmas tree is carried is relatively small as compared to the diameter of the foliage of the tree. Such an arrangement is inherently unstable usually resulting in the Christmas tree being easily tipped over.

U.S. Pat. No. 1,463,734 to Ulrich (1923) and U.S. Pat. No. 3,119,585 to Austenson (1964) revealed other types of stands that have extended the point of attachment of the stand up the Christmas tree trunk by extending one or more support members up from the base immediately adjacent the Christmas tree trunk. The location of the support members made it difficult to find locations adjacent the Christmas tree trunk for the support members to pass through the branches without adversely affecting the overall shape of the Christmas tree. other types of stands as those shown in U.S. Pat. No. 2,904,292 to Cloatheir (1939), U.S. Pat. No. 4,307,540 to Reisner (1981) and U.S. Pat. No. 4,381,621 to Eby (1983) use a support member which is displaced horizontally from the trunk of the Christmas tree and attached to the Christmas tree trunk through a horizontal member. Because of the Christmas tree weight, the Christmas tree may tend to rotate about its vertical axis creating a less stable Christmas tree support condition.

Another type support structure shown in U.S. Pat. No. 5,188,330 to Curtis, Jr. (1993) uses a support arrangement that includes a staff member that is mounted on the base so that its axis extends through the point of engagement with the tree trunk and a flexible strap is used to secure the tree trunk to the upper end of the staff member that may cause the tree to rotate about the flexible strap thereby creating a less stable tree support condition.

Therefore, a need existed for a Christmas tree support apparatus and method which would permit a Christmas tree to be firmly held and supported in a stable condition to prevent the tipping over thereof.

SUMMARY OF THE INVENTION

Accordingly, it is an object of this invention to provide an improved Christmas tree support apparatus and method.

It is a further object of this invention to provide an improved Christmas tree support apparatus and method which comprises a Christmas tree support stabilizer assembly that can be adapted to be used with Christmas tree support holder stands presently available on the market.

It is a still further object of this invention to provide an improved Christmas tree support apparatus and method which comprises a tree support stabilizer assembly that can be used in support of a crooked or irregularly shaped tree trunk so that the supported tree appears vertically straight and cannot be toppled easily.

It is still another object of this invention to provide an improved Christmas tree support apparatus and method which comprises a tree support stabilizer assembly which will require minimum removal of the lower branches from the trunk of the tree when it is placed in and attached to a tree support holder stand.

It is a further object of this invention to provide an improved Christmas tree support apparatus and method which comprises a collar member having a radial extension member connected thereto which is coupled to a rod means that is also attached to the Christmas tree above the height of the center of mass of the Christmas tree to prevent the Christmas tree from tipping over.

It is still another object of this invention to provide an improved Christmas tree support apparatus and method which permits quick assembly and quick disassembly of the Christmas tree support apparatus while still providing Christmas tree support stability.

It is a further object of this invention to provide an improved Christmas tree apparatus and method which can be easily installed, attached, aligned and secured to a Christmas tree at a height above the center of mass thereof by one person.

BRIEF DESCRIPTION OF THE PREFERRED EMBODIMENTS

Therefore, in accordance with one embodiment of this invention, a Christmas tree support apparatus is provided which comprises, in combination: a Christmas tree; a collar member located around a base portion of the Christmas tree and having a radial extension member connected thereto; and rod means having a first end portion attached to a portion of the Christmas tree and a second end portion connected to the radial extension member at a portion thereof spaced from the Christmas tree for providing a secure and angled support for the Christmas tree between the radial extension member and the Christmas tree. The Christmas tree support apparatus preferably also includes axial adjustment means provided in the radial extension member for permitting the second end portion of the rod means to be movably and removably connected to the radial extension member along an axial portion thereof. The radial extension member has a plurality of apertures located along the axial portion thereof. The second end portion of the rod means is attached to the radial extension member adjacent to one of the plurality of apertures. The axial adjustment means comprises the plurality of apertures, and attachment means for attaching the second end portion of the rod means to the radial extension member using the one of the plurality of apertures.

In accordance with another embodiment of this invention, a method of supporting a Christmas tree is provided which comprises the steps of: providing a Christmas tree; providing a collar member located around a base portion of the Christmas tree and having a radial extension member connected thereto; and providing rod means having a first end portion attached to a portion of the Christmas tree and a second end portion connected to the radial extension member at a portion thereof spaced from the Christmas tree for providing a secure and angled support for the Christmas tree between the radial extension member and the Christmas tree. This method preferably includes the step of providing axial adjustment means in the radial extension member for permitting the second end portion of the rod means to be movably and removably connected to the radial extension member along an axial portion thereof.

The foregoing and other objects, features and advantages of this invention will be apparent from the following more particular description of the preferred embodiments of the invention as illustrated in the accompanying drawings.

DESCRIPTION OF THE SPECIFICATION

Figure 1:
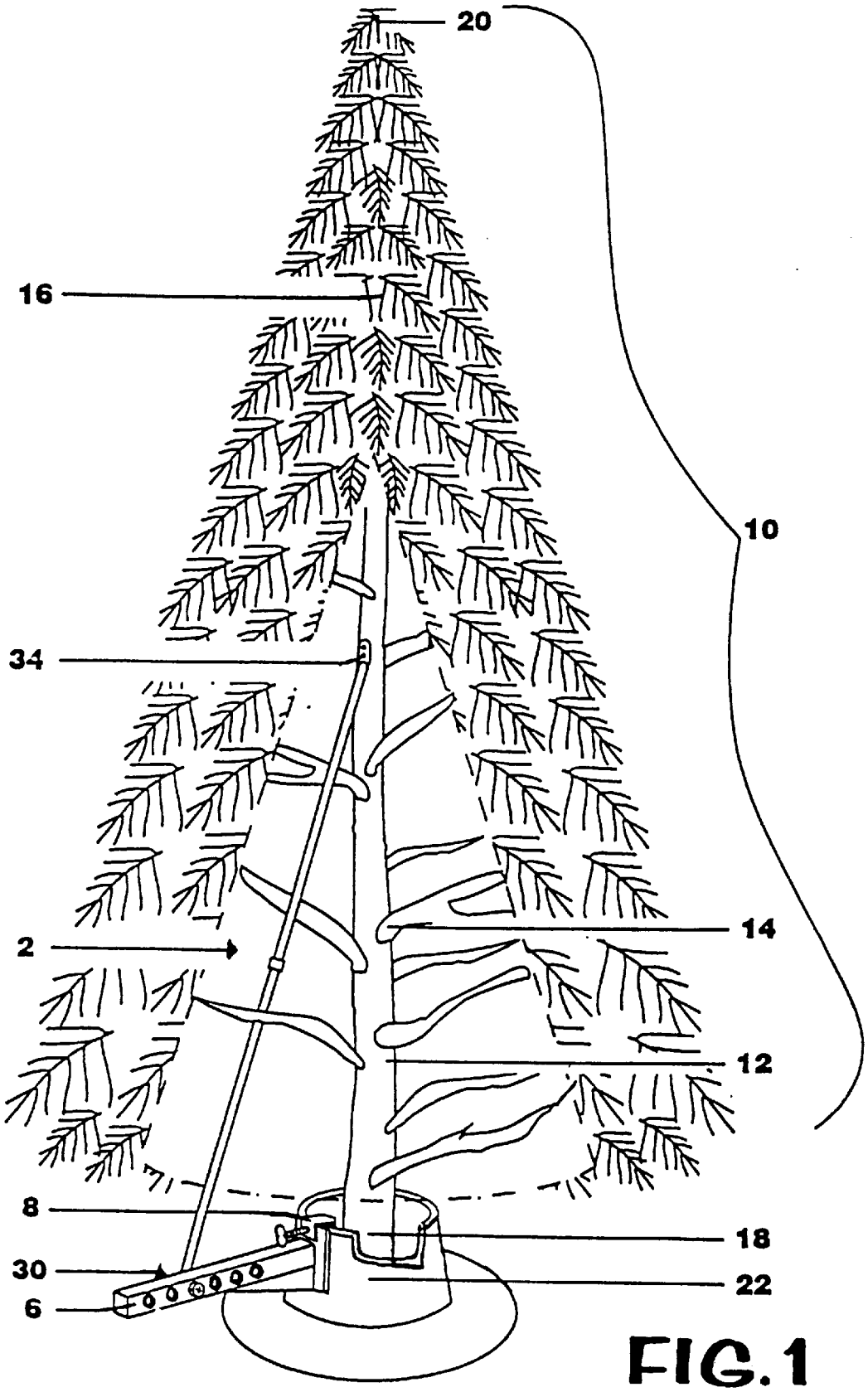
FIG. 1 is a perspective partially cut-away view of a Christmas tree illustrating the Christmas tree support apparatus and method of this invention for holding the Christmas tree in an upright position.

A Christmas tree apparatus in accordance with the present invention is illustrated in FIG. 1 wherein a tree support holder stand is designated by numeral 22. The tree support holder stand 22 is designed to support Christmas tree 10. The Christmas tree 10 includes a trunk 12, a plurality of branches 14 extending from the trunk 12 and foliage or leaves 16 on the branches 14. The trunk 12 further includes a butt end 18 which is also referred to as the tree base and a top 20 of the tree 10.

Referring to FIGS. 1–4 the Christmas tree support structure or apparatus includes the tree support holder stand or collar 22 which is used to support the butt end 18 of the Christmas tree 10. A thumb set screw 24 (see FIGS. 2, 3, and 4,) which extends through a screw hole in clamp member 8 to permit rapid attachment to and rapid detachment of the clamp 8 to the collar portion of the tree support holder stand 22, is also rapidly connected to and disconnected from a flange portion of radial extended arm or member 6 by means of the same type of thumb set screw 24. Connected to the radial extended arm or member 6 support assembly is preferably two interconnected elongated substantially rigid bar members or rod means 2 having a longitudinal and predetermined length and connected or mounted together telescopically to extend in one inch increments to the desired or required length. Apertures or holes spaced horizontally in the side of the extended radial arm 6 provide attachment and support for the elongated rigid support stabilizer bar or rod 2. This is accomplished by aligning the hole in lower flat end 30 of the stabilizer rod or bar 2 with the appropriate selected hole of the extended radial arm 6 followed by securing the stabilizer rod or bar 2 to the extended radial arm 6 by means of a mounting bolt and nut 4.

Figure 2:
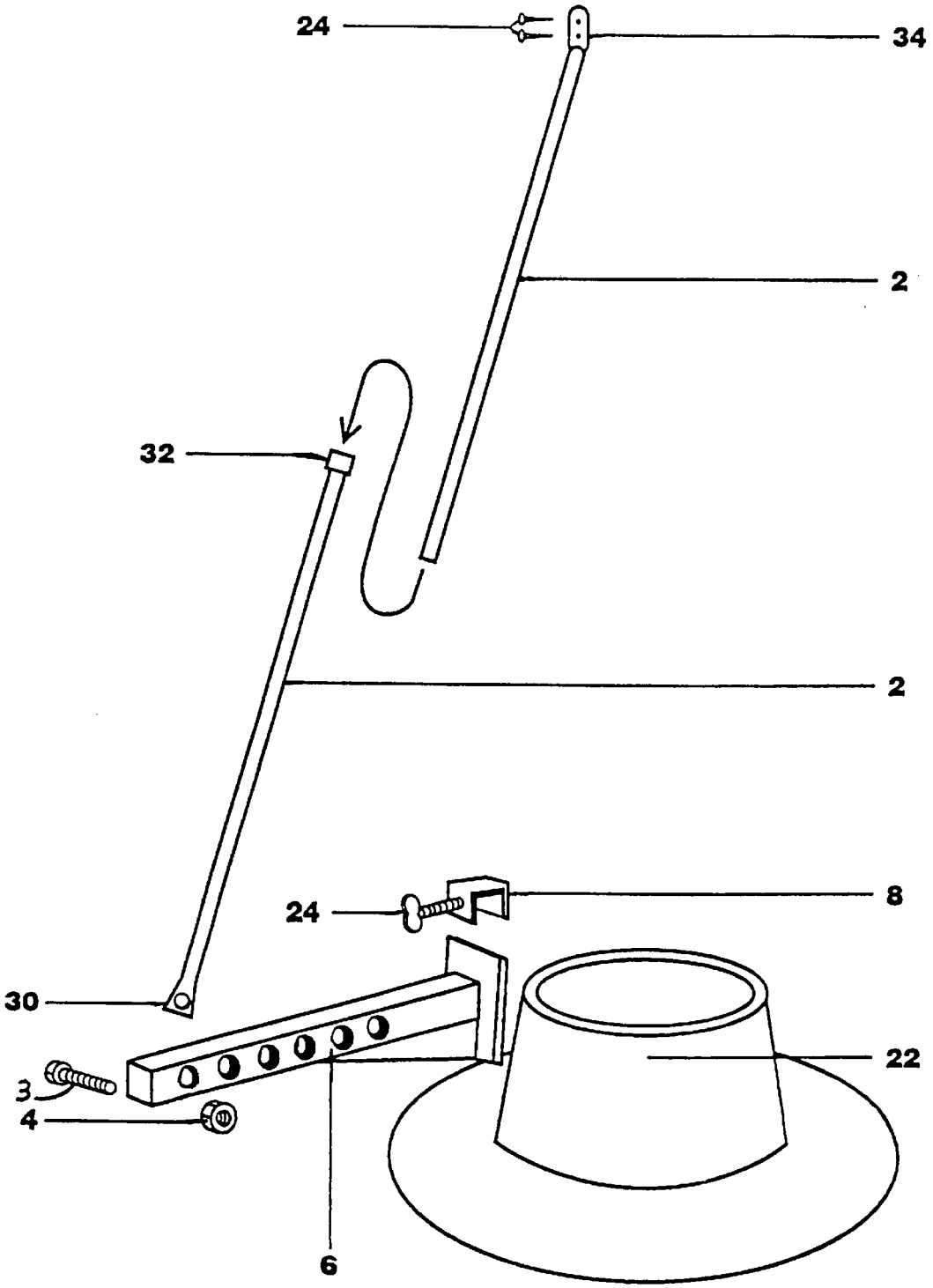
FIG. 2 as an exploded perspective view of the Christmas tree support apparatus of FIGS. 1 (without the Christmas tree).
Figure 3:
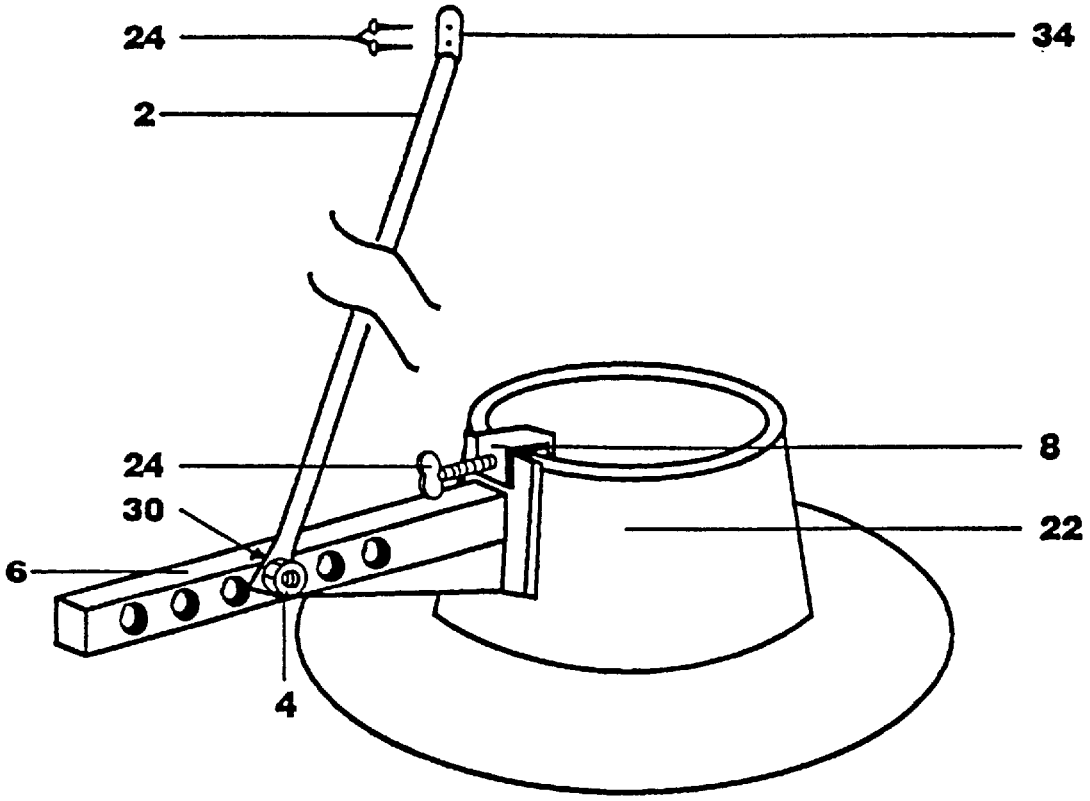
FIG. 3 is a perspective view of the Christmas tree support apparatus of FIG. 2 in an assembled condition.
Figure 4:
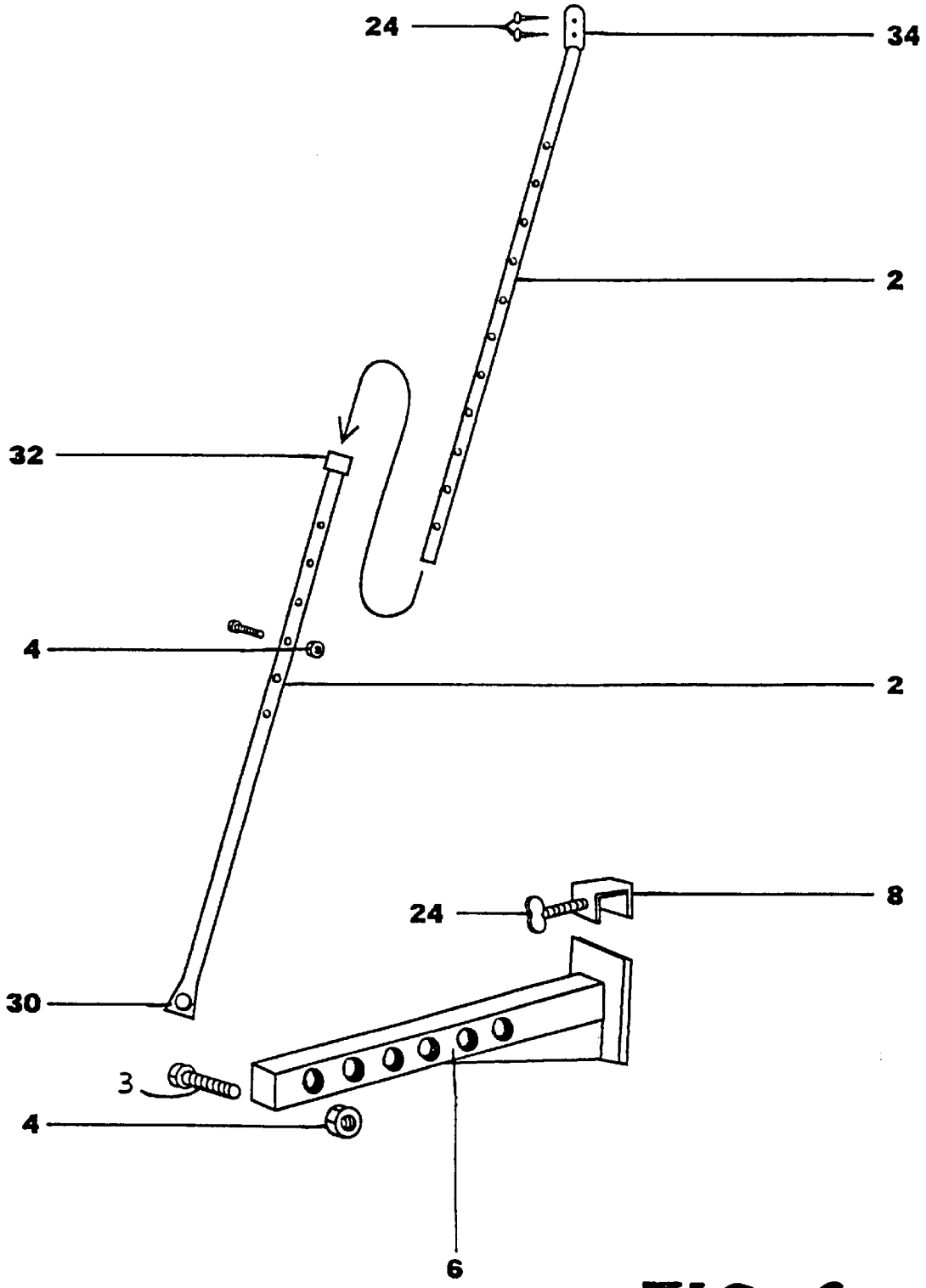
FIG. 4 is an exploded perspective view similar to FIG. 2, but without the Christmas tree and the tree support holder stand or collar.

Thus, lateral support of the Christmas tree 10 is provided by means of the support holder stand 22 and the connected stabilizer rod or bar support member designated by the reference numeral 2. The support stabilizer rod or bar 2 is preferably an elongated, substantial rigid stabilizer rod means having a longitudinal axis and a selected predetermined length. The stabilizer rod or bar 2 preferably has an upper flat end 34 approximately two inches long, bent approximately 25 to 30 degrees and preferably with two threaded holes spaced apart vertically for attachment by means of two thumb set type of screws 24 to the trunk 12. A lower flat end 30 of the stabilizer rod or bar 2, which is approximately two inches long and has an opening to match the appropriate or selected hole of the radial extended arm 6 is secured thereto by means of a nut 4 and bolt. While it may be made of one or any number of rod subparts, the stabilizer rod or bar 2 is shown in FIG. 2 as preferably comprising two rod sections telescopically coupled together by coupling 32 and adapted to extend in one inch increments to the required length for maintaining a stabilized tree. Also, this allows the stabilizer rod or bar 2 to be disassembled into subsections to facilitate storage when not in use.

As described above, the stabilizer rod or bar 2 is adjustably mounted by means of the nut 4 and bolt 3 through the opening of the lower flat end 30 thereof, into one of the holes located in the radial extended arm 6 that is connected by means of the clamp 8 which is removably secured to the collar portion of the tree support holder stand 22. This in effect will cause the stabilizer rod or bar 2 to angle inwardly from an outward end portion of the radial extended arm 6 to the projecting upper flat end 34 of the stabilizer rod or bar 2.

The support arrangement further includes an attachment means to the projecting upper flat end 34 of the stabilizer rod or bar 2 to engage the tree trunk 12. The stabilizer rod or bar 2's upper flat end 34 is preferably approximately two inches in length and bent approximately 25 to 30 degrees with preferably two threaded holes for attachment to the trunk 12 by two thumb set type of screws 24 spaced vertically at a height above the center of mass of the tree 10. This arrangement is such that the tree trunk 12 can be shifted slightly for adjustment. Also, the apparatus of this invention permits accommodation of different sizes and shapes of the tree trunk 12. The movement of the point of engagement with respect to the projecting upper flat end 34 of the stabilizer rod or bar 2 will still maintain the longitudinal axis of the stabilizer rod or bar 2 thereby minimizing force effects on the support arrangement of the tree support stabilizer rod or bar 2.

OPERATION

In the use and operation of the apparatus of this invention, the entire apparatus will normally be disassembled and stored until ready to be used. Hence, to support the tree 10, the user sets the base of the tree within the tree support holder stand 22 in an upright vertical position and traverses the stabilizer rod or bar 2 through an opening in the branches and leaves to a position adjacent the trunk 12. The stabilizer rod or bar 2 with the projecting upper flat end 34 is attached to the trunk 12 at a height above the center of mass of the tree 10 preferably using two thumb set type screws 24. After the stabilizer rod or bar 2 is attached to the tree 10, the butt end 18 of the tree trunk 12 is shifted as necessary and secured within the tree support holder stand 22 by any suitable means such as by the use of thumb set type screws (not shown) penetrating through openings (not shown) in the collar portion of the stand 22 into contact with the base 18 of the tree trunk 12.

As seen, the vertical height of the point of attachment between the projecting upper flat end 34 of the stabilizer rod or bar 2 and the support collar of the tree support holder stand 22 is preferably greater than the distance between the collar of the tree support holder stand 22 and the center of mass of the tree 10. The center of mass of the Christmas tree 10 is typically somewhere between 30–35 percent of the tree height as measured upwardly from the butt end 18 of the tree 10. While the attachment height may be varied as long as attachment is made above the center of mass of the tree 10 to be supported, having the attachment height at 40 percent or more of the height of the tree 10 to be supported insures that support stability therefor is maintained.

Since the stabilizer rod or bar 2 engages the tree trunk 12 above the tree's center of mass in the embodiment of FIG. 1, this tree support apparatus arrangement is very stable. With the action weight of the tree 10 located below the point of engagement of the upper flat end 34 of the rod means or bar 2, this always forces the butt end 18 of the tree trunk 12 towards the bottom portion of the tree support holder stand 22. As a result, the tree 10 and stand 22 are less susceptible to being tipped over than prior art stands.

Moreover, since the distance of the projecting upper flat end 34 of the rod means 2 from the collar of the tree support holder stand 22 is greater than the distance of the center of mass, the lateral force exerted on the external end portion of the stabilizer rod or bar 2 is minimized holding the tree 10 in place within the stand 22 and resisting any tipping forces that might inadvertently be applied to the tree 10.

Although the description above contains many specificities, these should not be construed as limiting the scope of the invention, but as merely providing illustrations for some of the presently preferred embodiments of this invention. For example, the tree support stabilizer rod or bar 2 can have different shapes, such as rectangular, oval, triangular, circular, etc.; the radial extension member 6 can have other shapes than as shown in the drawings and the attachment thereof to the rod means or bar 2 can be varied, as desired.

Thus the scope of the invention should be determined by the appended claims and their legal equivalents rather than by the specific examples given.

What is claimed is:

1. A Christmas tree support apparatus comprising, in combination:

a Christmas tree;

a collar member located around a bane portion of said Christmas tree and having a radial extension member connected thereto; and rod means having a first end portion attached to a portion of said Christmas tree and a second end portion connected to said radial extension member at a portion thereof spaced from said Christmas tree for providing a secure and angled support for said Christmas tree between said radial extension member and said Christmas tree, said radial extension member having a plurality of spaced apart means for permitting attachment to said second end portion of said rod means for selectively varying an angle formed by said rod means with said Christmas tree to permit support of said Christmas tree for different sizes and shapes thereof.

2. The Christmas tree support apparatus of claim 1 wherein said spaced apart means comprising axial adjustment means provided in said radial extension member for permitting said second end portion of said rod means to be movably and removably connected to said radial extension member along an axial portion thereof.

3. A Christmas tree support apparatus comprising, in combination:

a Christmas tree;

a collar member located around a base portion of said Christmas tree and having a radial extension member connected thereto; and rod means having a first end portion attached to a portion of said Christmas tree and a second end portion connected to said radial extension member at a portion thereof spaced from said Christmas tree for providing a secure and angled support for said Christmas tree between said radial extension member and said Christmas tree; and axial adjustment means are provided in said radial extension member for permitting said second end portion of said rod means to be movably and removably connected to said radial extension member along an axial portion thereof, said radial extension member having a plurality of apertures located along said axial portion thereof, said second end portion of said rod means being attached to said radial extension member adjacent to one of said plurality of apertures, said axial adjustment means comprising said plurality of apertures, and attachment means for attaching said second end portion of said rod means to said radial extension member using said one of said plurality of apertures.

4. The Christmas tree support apparatus of claim 3 wherein said attachment means comprising a bolt and nut connected to each other with said bolt extending through both said one of said plurality of apertures and an opening in said second end portion of said rod means.

5. The Christmas tree apparatus of claim 4 including removable coupling means for removably coupling said radial extension member to said collar member.

6. The Christmas tree apparatus of claim 5 wherein said removable coupling means comprising a substantially U-shaped clamping member having an opening in one leg of said U-shaped clamping member, and bolt means penetrating said opening for clamping said U-shaped clamping member to hold said radial extension member in gripping contact with a portion of said collar member.

7. The Christmas tree apparatus of claim 6 wherein said radial extension member having a flange portion, said U-shaped clamping member holding said flange portion of said radial extension member against an exterior side portion of said collar member.

8. A method of supporting a Christmas tree comprising the steps of:

providing a Christmas tree;

providing a collar member located around a bass portion of said Christmas tree and having a radial extension member connected thereto; and providing rod means having a first end portion attached to a portion of said Christmas tree and a second end portion connected to said radial extension member at a portion thereof spaced from said Christmas tree for providing a secure and angled support for said Christmas tree between said radial extension member and said Christmas tree, said radial extension member having a plurality of spaced apart means for permitting attachment to said second end portion of said rod means for selectively varying an angle formed by said rod means with said Christmas tree to permit support of said Christmas tree for different sizes and shapes thereof.

9. The method of claim 8, said spaced apart means comprising axial adjustment means in said radial extension member for permitting said second end portion of said rod means to be movably and removably connected to said radial extension member along an axial portion thereof.

10. A method of supporting a Christmas tree comprising the steps of:

providing a Christmas tree, providing a collar member located around a base portion of said Christmas tree and having a radial extension member connected thereto;

providing rod means having a first end portion attached to a portion of said Christmas tree and a second end portion connected to said radial extension member at a portion thereof spaced from said Christmas tree for providing a secure and angled support for said Christmas tree between said radial extension member and said Christmas tree; and providing axial adjustment means in said radial extension member for permitting said second end portion of said rod means to be movably and removably connected to said radial extension member along an axial portion thereof;

said radial extension member having a plurality of apertures located along said axial portion thereof, said second end portion of said rod means being attached to said radial extension member adjacent to one of said plurality of apertures, said axial adjustment means comprising said plurality of apertures, and attachment means for attaching said second end portion of said rod means to said radial extension member using said one of said plurality of apertures.

11. The method of claim 10 wherein said attachment means comprising a bolt and nut connected to each other with said bolt extending through both said one of said plurality of apertures and an opening in said second end portion of said rod means.

12. The method of claim 11 including removable coupling means for removably coupling said radial extension member to said collar member.

13. The method ot claim 12 wherein said removable coupling means comprising a substantially U-shaped clamping member having an opening in one leg of said U-shaped clamping member, and bolt means penetrating said opening for clamping said U-shaped clamping member to hold said radial extension member in gripping contact with a portion of said collar member.

14. The method of claim 13 wherein said radial extension member having a flange portion, said U-shaped clamping member holding said flange portion of said radial extension member against an exterior side portion of said collar member.

* * * * *